US006188005B1

(12) United States Patent
White

(10) Patent No.: US 6,188,005 B1
(45) Date of Patent: Feb. 13, 2001

(54) STRINGED INSTRUMENT SOUNDBOARD INCLUDING LATTICE-LIKE ACOUSTIC GRILL

(75) Inventor: Timothy P. White, New Boston, NH (US)

(73) Assignee: Chrysalis Guitar Company, New Boston, NH (US)

( * ) Notice: Under 35 U.S.C. 154(b), the term of this patent shall be extended for 0 days.

(21) Appl. No.: 09/384,511

(22) Filed: Aug. 27, 1999

Related U.S. Application Data

(63) Continuation-in-part of application No. 09/129,931, filed on Aug. 6, 1998, now Pat. No. 5,945,614.

(51) Int. Cl.[7] ..... G10D 1/08; G10D 3/00
(52) U.S. Cl. ..... 84/291; 84/267; 84/293
(58) Field of Search ..... 84/267, 291, 292, 84/293

(56) References Cited

U.S. PATENT DOCUMENTS

| | | | | |
|---|---|---|---|---|
| 3,685,385 | * | 8/1972 | Rendell | 84/267 |
| 4,073,211 | | 2/1978 | Jorgensen | 84/291 |
| 4,111,093 | | 9/1978 | Field et al. | 84/267 |
| 4,359,923 | * | 11/1982 | Brunet | 84/267 |
| 4,433,603 | | 2/1984 | Siminoff | 84/1.16 |
| 4,573,391 | | 3/1986 | White | 84/291 |
| 4,686,882 | | 8/1987 | Shaw | 84/291 |
| 5,058,479 | | 10/1991 | Shaw | 84/291 |
| 5,461,958 | * | 10/1995 | Dresdner et al. | 84/267 |
| 5,952,592 | * | 9/1999 | Teel | 84/291 |

* cited by examiner

*Primary Examiner*—Stanley J. Witkowski
(74) *Attorney, Agent, or Firm*—Bourque & Associates, P.A.

(57) ABSTRACT

An improved stringed instrument soundboard system. The system includes a soundboard frame having a peripheral rim member, which extends from first and second ends of the soundboard frame. The peripheral rim member defines a peripheral shape of the soundboard frame. The soundboard system also includes an acoustic grill, which is made up of at least one grill sections, and which corresponds substantially to the shape of the soundboard frame. Each grill section has a peripheral rim, which is attached to the peripheral rim member of the soundboard frame.

20 Claims, 14 Drawing Sheets

STRINGED INSTRUMENT SOUNDBOARD INCLUDING LATTICE-LIKE ACOUSTIC GRILL

RELATED APPLICATIONS

This is a continuation-in-part of U.S. application Ser. No. 09/129,931, filed Aug. 6, 1998, now U.S. Pat. No. 5,945,614, issued Aug. 31, 1999, which is fully incorporated herein by reference.

FIELD OF THE INVENTION

The disclosed invention relates to stringed instruments and, in particular to an improved stringed instrument soundboard system.

BACKGROUND OF THE INVENTION

Guitars generally consist of a body and an elongated neck and a plurality of strings, which are tensioned between a headstock at one end of the neck and a bridge, which is attached to the guitar body. In an acoustical guitar, the guitar body consists of spaced panels, including a body face panel, a body back panel and body side panels, which define a resonance chamber to provide the instrument with a desired tonal qualities.

The rigid attachment of the neck to the body and the size of the body causes the guitar to be relatively large and cumbersome to handle, transport and store. However, the need for strength within the body and neck to allow the guitar strings to be tensioned, and the requirement for the resonant chamber of the body has dictated acoustical guitar construction and bulk. A number of inventions have considered guitar constructions, which attempt to reduce the bulk of guitars for transportation and storage purposes. Examples of such inventions can be found in U.S. Pat. Nos. 4,073,211; 4,111,093; 4,433,603; 4,686,882; and 5,058,479. Many of these prior art collapsible guitars still result in a bulky size and require special carrying cases and special care when transporting. Others are more compact and are easily transportable. However, in order to provide such compactability, these guitars sacrifice acoustic performance.

U.S. Pat. No. 4,573,391, which issued to and is commonly owned by the applicant of the present invention, discloses an inflatable knock-down guitar, which overcame many of the deficiencies found in many of the prior art knock-down guitar patents. This reference teaches a knock-down guitar, which can be utilized in either an acoustic or electric mode, and which includes a plurality of guitar components that disassemble in such a manner as to permit the instrument to be placed within a conventional suitcase, thus eliminating the need for special carrying cases.

The '391 patent teaches that an inflatable bladder can be utilized as a resonance chamber for the guitar system disclosed therein when it is used in its acoustical mode. This guitar system, which is known as the CHRYSALIS™ Universal Guitar System, includes a family of interchangeable guitar components, which provides a number of features including: the ability of a guitarist to break down a full-size, full-function electric guitar to a shirt box size package for transport and to re-assemble the instrument to playing condition in a minimal time period, including the re-tuning and re-tuning of the guitar strings; allowing the same electric guitar to be quickly and easily converted to a full-size, full-function acoustic guitar by attaching an inflatable acoustic chamber to the guitar body; allowing a musician to easily and quickly make a variety of significant alterations to the guitar's quality or function by providing a plurality of separately available interchangeable components, including, headstocks, necks, body panels and bridges.

The advantages of the CHRYSALIS™ guitar system include the ability to assemble the instrument in any configuration and to maintain that configuration entirely by string tension. Furthermore, the CHRYSALIS™ guitar system teaches that all system components can be manufactured out of injection molded plastics common carbon fiber composites or lightweight metals, which allows a wide range of system performance characteristics and associated price ranges. Additionally, with the CHRYSALIS™ guitar system, all action, neck, and intonation adjustments could be made with three easily accessible set screws at the junction of the CHRYSALIS™ guitar's neck and body.

However, perhaps the most significant advance taught by the CHRYSALIS™ guitar system is the use of a new type of acoustic sound board analogue composed of a carbon fiber composite grillwork, which, in the CHRYSALIS™ guitar's acoustic mode supports a polymer membrane under tension.

One embodiment of a prior art modular guitar system 1 is shown in FIG. 1. Guitar 1 consists of a guitar body 2, a guitar neck 4, a headstock 6, bridge 8 and a plurality of strings (not shown). The strings are attached to the bridge 8 at one end and, at the headstock, the strings are attached to individual guitar string tuning machines 12.

The prior art guitar body 2 includes a face panel 14 consisting of first and second face panel sections 14A and 14B, respectively. The face panel sections are preferably formed in a lattice configuration and are made of any one of a number of synthetic materials, such as fiberglass and resin. The face panel 14 includes a periphery 16 panel which defines the shape of guitar body 2 when guitar body sections 14A and 14B are assembled.

Guitar body sections 14A and 14B are each provided with a pair of dovetail recesses 18, which are configured to accept corresponding dovetail projections 20, which are provided on the underside of guitar bridge 8.

The guitar body sections 14 are also provided with recesses 22, which are configured to accept neck section 4. The body section 14 is maintained in its proper relationship by joining corresponding mating surfaces 24 and 26, inserting neck section 4 into recesses 22 and inserting bridge projections 20 into their corresponding dovetail recesses 18 on body sections 14A and 14B.

The prior art neck section further includes dowels 30, which extend through neck wings 34 and into holes 32 in body face panels 14A and 14B. This configuration maintains the alignment of neck section 4 with respect to body 2.

At its outer end, neck 36 is provided with an angle block 38, which engages the outer end of the neck and includes a pair of elongated rectangular pins 40 received within neck slots 42. A retainer plate 44 attaches to the underside of neck 36 overlapping slots 42 to maintain pins 40 within their respective slots. A screw 46 holds retainer plate 44 in place.

Angle block 38 also includes two angled pins 48, which extend from angle block 38 in a direction opposite elongated rectangular pins 40, which is the direction of headstock 50.

The headstock 50 includes holes, not shown for receiving angled pins 48 in order to align headstock 50 with neck 36 via angle block 50. The headstock 50 also includes a recess on its underside for receiving a tensioning lever 52 pivoted about pivot shaft 54. Tensioning lever 52 includes a convex cam surface adapted to engage the angle block between pins 48 and, as will be appreciated, rotation of lever on 52 vary the distance between angle block 38 and headstock 50. Thus, the guitar strings attached to tuning machines 12 at one end and bridge section 8 at their other ends may be tensioned and detensioned as lever arm 52 is repositioned.

The body section 2 further includes an inflatable acoustic chamber, which is made up of a flexible envelope 60 within which an inflatable bladder 62 is inserted. The envelope 60 is attached to the periphery of body face panels 14 using an attachment means 72 such as a zipper, Velcro components, snaps or similar fasteners.

The prior art also discloses interchangeable bridges, such as electrical guitar bridge 8'. Electric guitar bridge 8' includes components necessary to convert the modular guitar system 1 from an acoustic mode 2 and electric mode. Electric guitar bridge 8 thus includes pickups 82, and controls 84. The electric guitar bridge 8', like acoustic guitar bridge 8 includes dovetail projections 20', which are configured to be accepted within dovetail recesses 18 on body base panels 14A and 14B respectively.

As disclosed in the '391 patent, the CHRYSALIS™ guitar body is comprised of two separate body grills, which are held together and in planner alignment by the guitar's bridge and a common neck joint. However, one drawback of the CHRYSALIS™ guitar system is that the separate body grills taught therein include both structural and acoustical braces. Accordingly, if one were to desire to modify the acoustical characteristics of the prior art CHRYSALIS™ guitar, one would be forced to replace both body grills in their entirety.

Another drawback of the combined structural and acoustical braces of the prior art CHRYSALIS™ guitar system is that the acoustical braces communicate with the structural braces along each body grill's central, longitudinal structural brace. This, although offering superior structural integrity, limits the vibrational characteristics of the acoustical braces, which adversely affects the acoustic performance of the CHRYSALIS™ guitar system.

Another drawback associated with the combined structural and acoustical frameworks of the prior art CHRYSALIS™ guitar is that in order to provide proper sound board analog acoustic compliance, the two body halves are only joined where they attach to the guitar neck and by the string bridge. Accordingly, in order to provide the necessary structural integrity, the body frame edges that are located along the central longitudinal axis of the guitar body in the assembled state, must themselves be structural frame members. This requires substantial dimensions, which further precludes the acoustical framework from freely vibrating and transmitting maximum vibrational energy to the guitar's acoustical chamber.

The prior art CHRYSALIS™ guitar includes a removable headstock, which rotates vertically off the neck of the guitar to allow the breakdown of the instrument as a whole. The CHRYSALIS™ guitar headstock utilizes a quick release mechanism, which allows for the rapid de-tensioning and re-tensioning of the guitar strings utilizing a lever mechanism. However, when the CHRYSALIS™ guitar strings are de-tensioned, they tend to unravel from the tuning machine posts provided on the headstock, which defeats the ability to rapidly reassemble and tune the guitar. One attempt that has been tried to overcome this problem is to add an external, add-on string clamp at the base of the headstock, which can be manually manipulated prior to de-tensioning the guitar strings using the headstock lever arm. Once the clamp is tightened, tension is maintained on each string between the clamp and their respective tuning machine posts, thus preventing unwanted string unraveling. However, this prior art solution to the problem requires a separate operator action and requires a somewhat unsightly additional mechanism on the guitars headstock.

Furthermore, the prior art CHRYSALIS™ guitar system, while teaching the interchangeability of necks, bridges, and headstocks, the neck body joint taught is crude and does not provide the ease of interchangeability required for commercial acceptance. Furthermore, since the neck of the prior art CHRYSALIS™ guitar serves more purposes than that of a normal guitar neck, the prior art CHRYSALIS™ guitar neck was required to be made from either solid high-modulus graphite-epoxy composite, aluminum stock or an equivalent solid structure.

Accordingly, there is a need for an improved inflatable, knock-down guitar, which overcomes the acoustic compliance, assembly, and structural deficiencies associated with prior art collapsible guitar systems, including the prior art CHRYSALIS universal guitar system.

SUMMARY OF THE INVENTION

The disclosed invention provides an improved stringed instrument soundboard system. The system includes a soundboard frame having at least one peripheral rim member, which extends intermediate first and second ends of the soundboard frame. The peripheral rim member(s) define a peripheral shape of the soundboard frame, which may include an upper bout and a lower bout. The soundboard system also includes an acoustic grill, which is made up of at least one grill section, and which corresponds substantially to the shape of the soundboard frame. Each grill section has a peripheral rim, which is removably attached to a corresponding one of the peripheral rim members. In the preferred embodiment, which utilizes two grill sections, each section also includes a central, longitudinal edge, which is free to vibrate independent of the soundboard frame.

The soundboard system also includes at least one bridge attachment point on said at least one acoustic grill section. A string bridge is also provided, which communicates with the grill section(s) at the bridge attachment point(s). The string bridge removably retains at least one instrument string at a bridge end of each said string and acoustically couples the instrument string(s) to the acoustic grill section(s).

In one preferred embodiment of the invention, the soundboard frame comprises two frame sections, which have mating surfaces along a central, longitudinal axis of the soundboard to provide a substantially rigid soundboard frame central member disposed along the central, longitudinal axis when the soundboard frame section mating surfaces are mated. Each frame section further includes a peripheral rim member, which extends from the mating surfaces to define a peripheral shape of the soundboard frame. Thus, by including a two-section soundboard frame, a stringed instrument utilizing a soundboard system according to the present embodiment of the invention can be disassembled to a further reduced size to facilitate transport and storage.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

Figure 1:
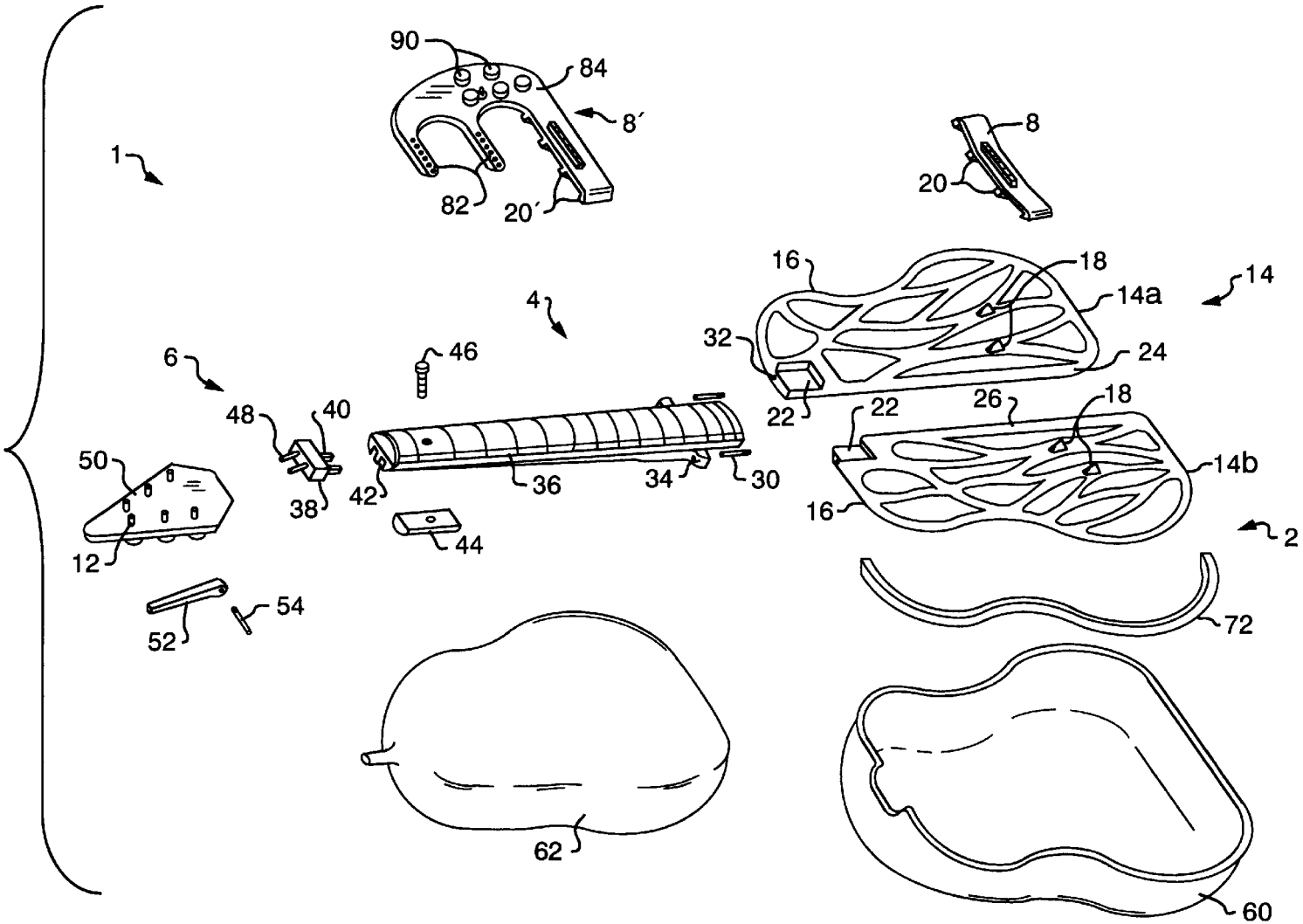
FIG. 1 is an exploded, perspective view of a prior art CHRYSALIS guitar system.
Figure 2:
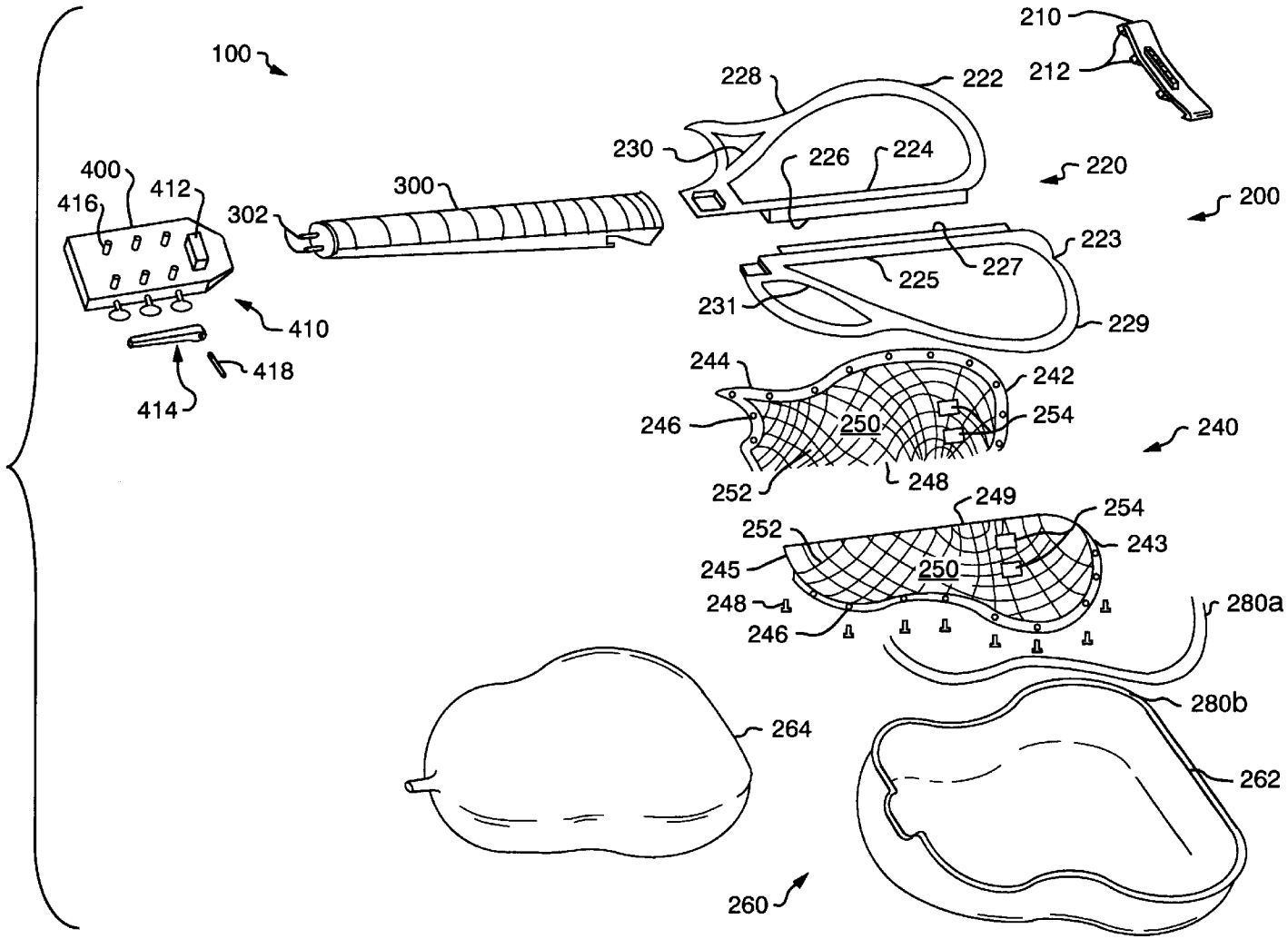
FIG. 2 is an exploded, perspective view of the modular guitar system of the present invention.

One embodiment of a modular guitar system 100 according to the teachings of the present invention is shown in FIG. 2. Like its prior art inflatable guitar sibling, modular guitar system 100 includes a plurality of components, which are joined together to form a playable instrument. Modular guitar system 100 includes guitar body section 200, guitar neck section 300 and guitar headstock section 400.

Guitar body section 200 includes guitar bridge 210, guitar body frame 220, acoustic grill 240, acoustic chamber 260, which is attached to guitar body frames 220 using attachment means 280.

Figure 4:
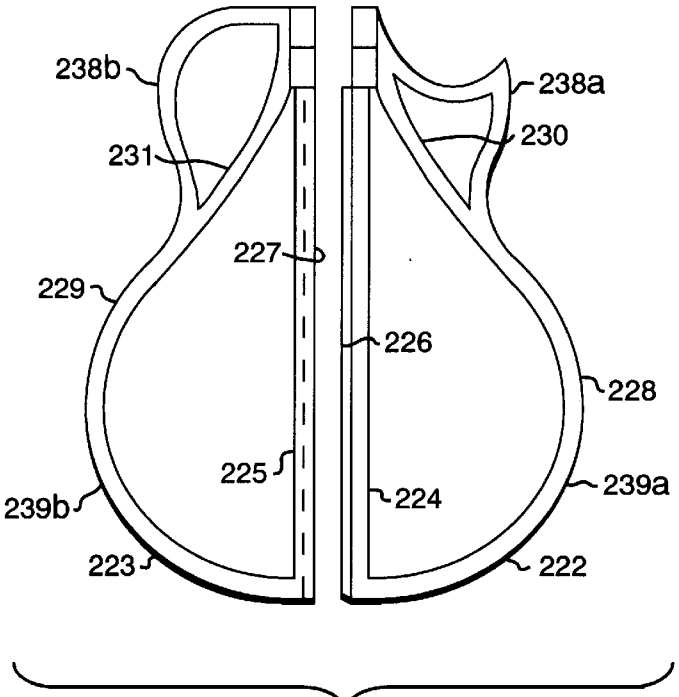
FIG. 4 is a top view of a guitar body frame according to a second embodiment of the invention, which includes two guitar body structural frame sections.

In one embodiment of the invention guitar body frame 220 includes first and second structural body frame sections 222 and 223 (FIGS. 2 and 4). Each structural body frame section includes a longitudinal, central member 224 and 225, which include corresponding mating surfaces 226 and 227.

Structural body frames sections 222 and 223 also include peripheral rim members 228 and 229, which extend from first and second ends of longitudinal members 224 and 225 and, which define the peripheral shape of the guitar body, including upper bouts 238*a*, 238*b* and lower bouts 239*a*, 239*b* of the guitar body frame 220 when the first and second sections 222 and 223 are mated using corresponding mating surfaces 226 and 227. Each structural body frame section also includes at least one additional structural member 230 and 231, which in the embodiment illustrated in FIG. 2 are shown as buttresses connecting the first end of each guitar body longitudinal member 224 and 225 to its corresponding peripheral rim member 228 and 229 substantially at the lower bout of each body frame section. This arrangement provides superior structural integrity to the structural body frame sections when they are exposed to guitar string tension. As will be explained more fully below, this arrangement allows a structural skeleton to be housed within a housing to provide superior structural integrity at a low cost.

In one embodiment, mating surfaces 226 and 227 comprise a longitudinal dovetail joint disposed substantially along the entire length of longitudinal numbers 224 and 225. Since it is envisioned that structural body frame sections 222 and 223 may be manufactured using injection molding or like processes, which could result in minor molding inconsistencies and imperfections, in the preferred embodiment, mating dovetails 226 and 227 include a hollow male dovetail section 226, which provides suitable flexibility in order to account for molding inconsistencies and, at the same time, provides structural integrity.

Figure 8A:
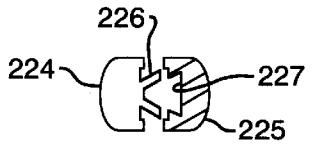
FIG. 8A is a close-up sectional view of one embodiment of the guitar body frame longitudinal mating surfaces.
Figure 8B:
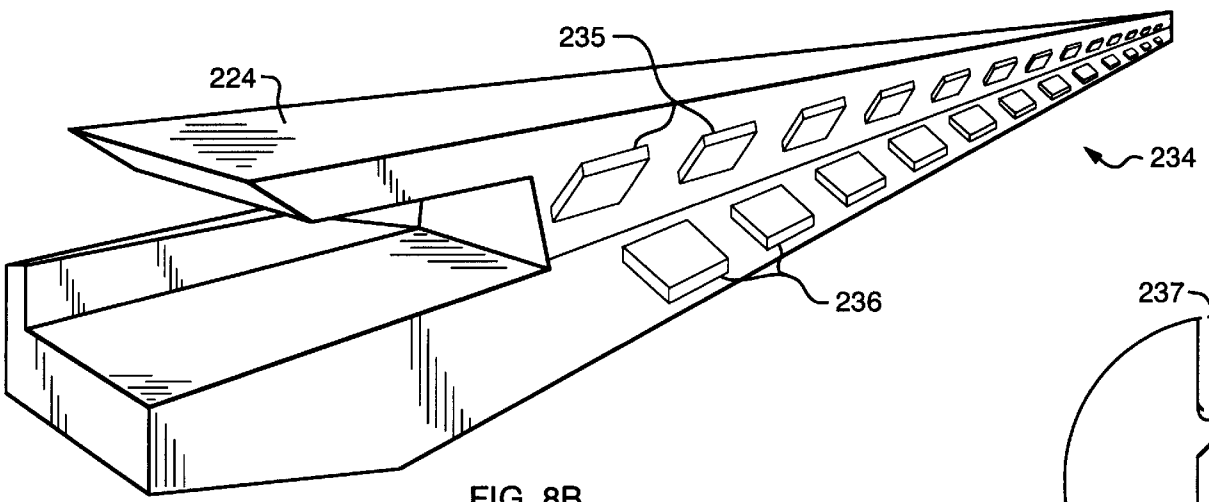
FIG. 8B is a perspective view of a second embodiment of a hollow, segmented male member of the guitar body frame longitudinal mating surfaces.
Figure 8C:
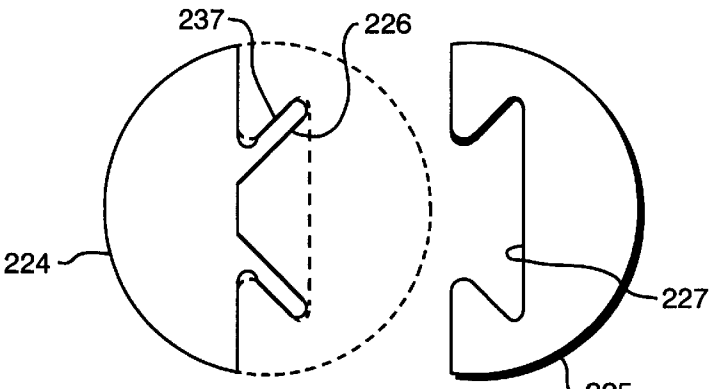
FIG. 8C is a close up sectional view of another embodiment of the guitar body frame longitudinal mating surfaces.
Figure 9A:
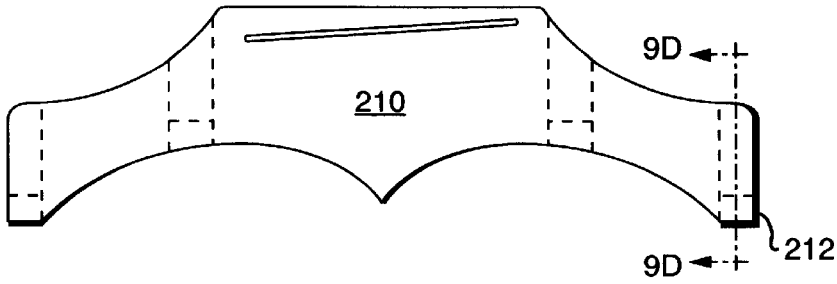
FIG. 9A is a top view of the guitar bridge of FIG. 7.
Figure 9B:
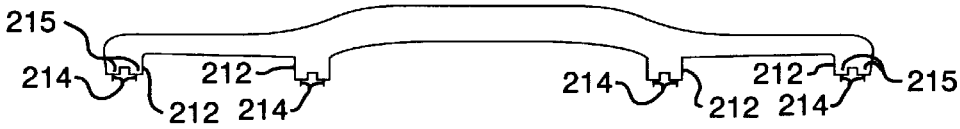
FIG. 9B is an end view of the guitar bridge of FIG. 9A.
Figure 9C:
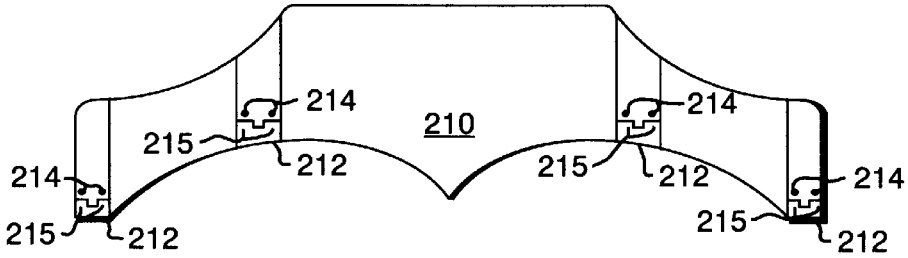
FIG. 9C is a bottom view of the guitar bridge of FIGS. 9A and 9B.
Figure 9D:
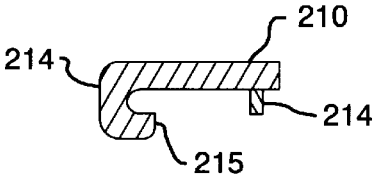
FIG. 9D is a sectional view of the guitar bridge taken along line DD of FIG. 9A.

In another embodiment, hollow male dovetail section 226 comprises a segmented dovetail 234 (FIG. 8B), which includes alternating upper and lower dovetail projections 235 and 236, respectively. This arrangement allows for even greater flexibility to account for molding imperfections. In either hollow dovetail arrangement mentioned above, the dovetail projections may be slightly convex mating surfaces, 237, which provide a single line of contact along each dovetail projection. Again, this arrangement is tailored to allow proper joints to be formed even in the presence of molding imperfections.

Figure 3A:
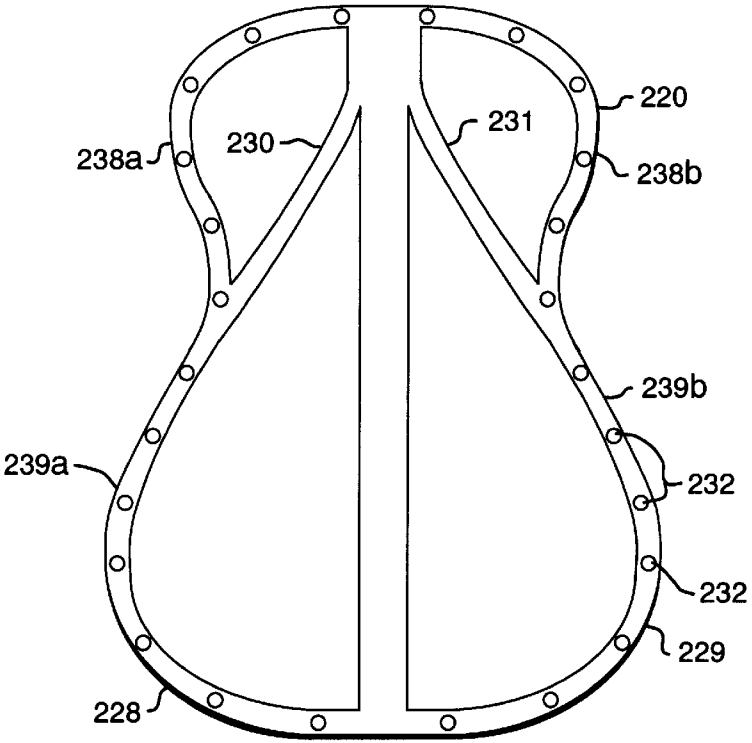
FIG. 3A is a bottom view of a guitar body frame according to a first embodiment of the invention.
Figure 3B:
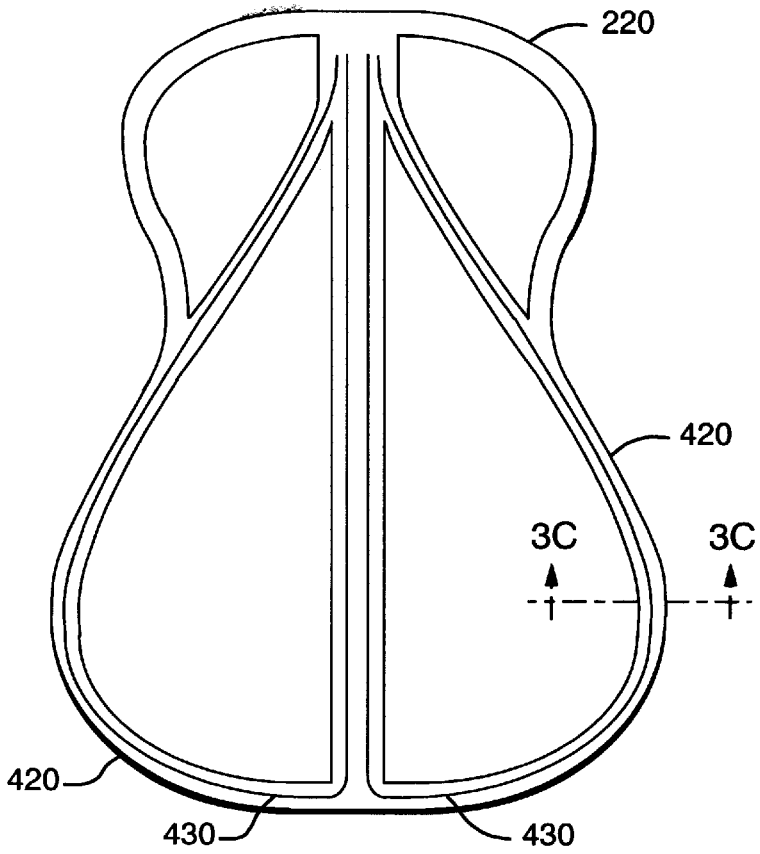
FIG. 3B is a top view of a guitar body frame according to the embodiment of FIG. 3A showing a structural skeleton housed within the frame.
Figure 3C:
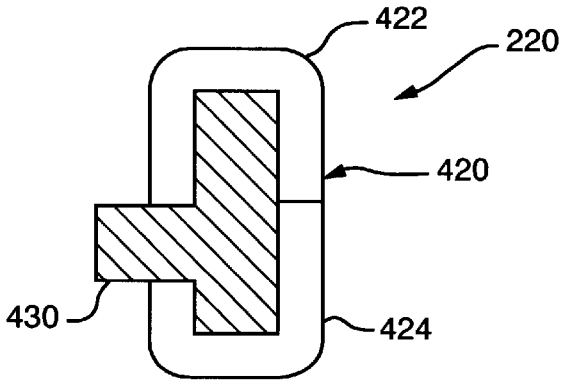
FIG. 3C is a sectional view of the guitar body frame of FIG. 3B including the skeleton housed within the frame.
Figure 5A:
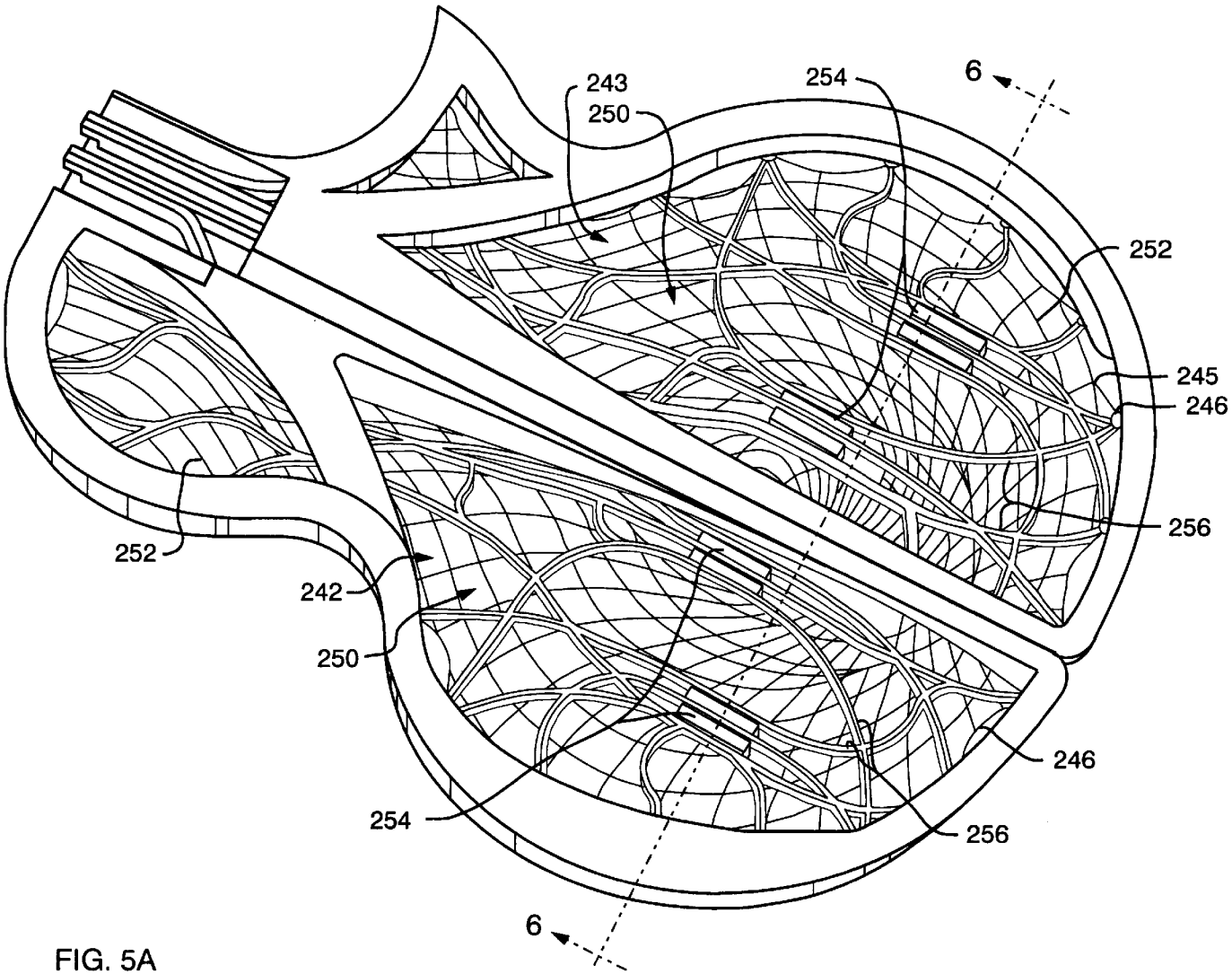
FIG. 5A is a top perspective view of the disclosed first and second acoustic grill sections mounted within a guitar body frame.
Figure 5B:
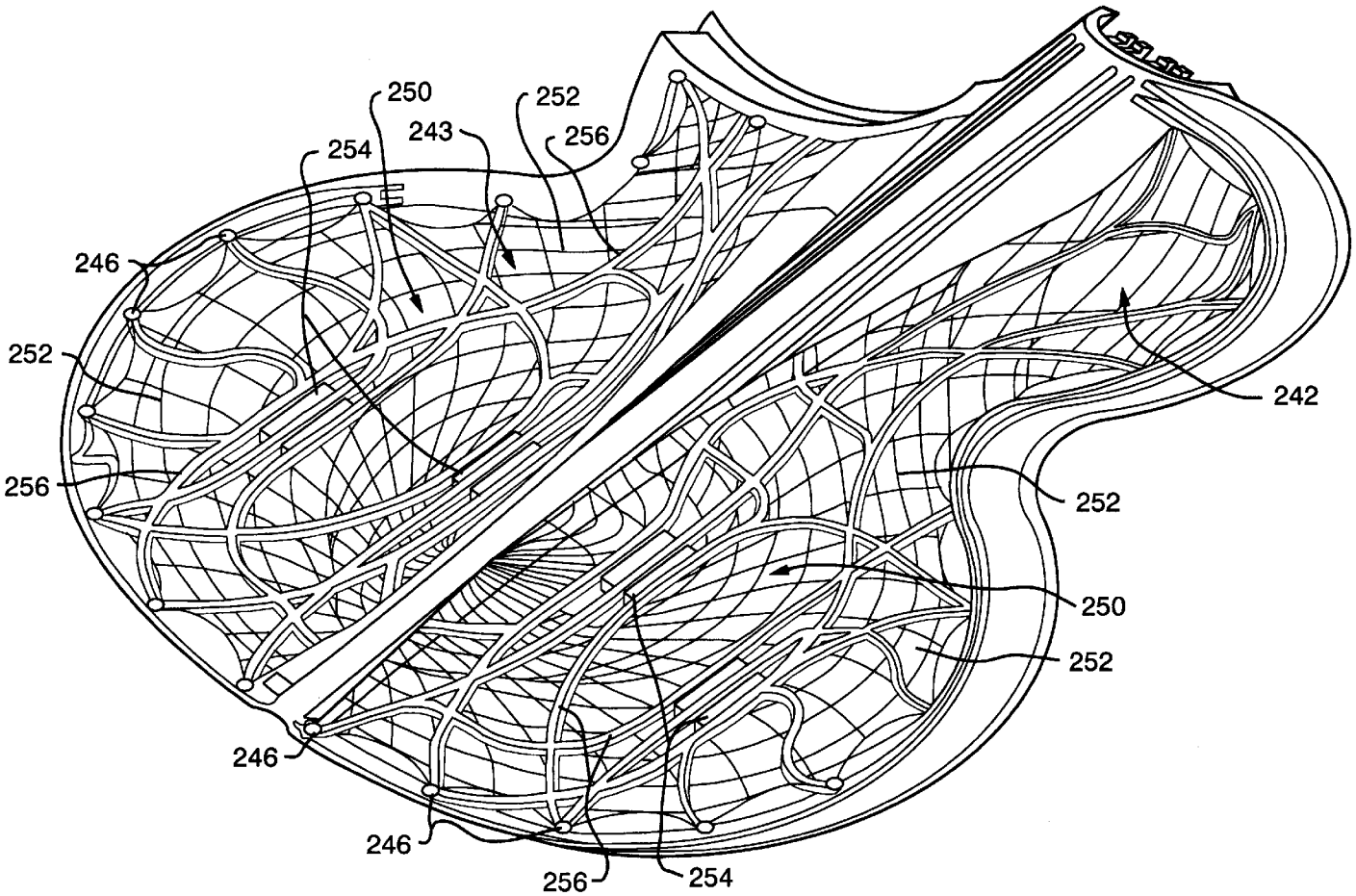
FIG. 5B is a bottom perspective view of the disclosed first and second acoustic grill sections mounted within a guitar body frame.

FIG. 3A shows a body frame 220 made up of a single frame section, which is not divisible along a central longitudinal axis. However, in either the one piece or two piece body frame embodiments, the body frame may be comprised only of load bearing, structural materials or, in the alternative may include multiple piece frame member(s), which house a structural skeleton within an aesthetic or decorative housing. Such a configuration is shown in FIGS. 3B and 3C. Body frame 220 is comprised of a housing 420, which encloses a structural skeleton 430. The skeleton 430 may be formed of any suitable load carrying material, such as aluminum or other metals, composites, including graphite-reinforced composites or any other suitable material.

The skeleton is formed into a suitable shape to allow it to be either partially or totally enclosed within the housing 420 and to allow other components, such as the acoustic soundboard system be attached thereto. The housing 420 may be constructed of relatively inexpensive materials, such as plastics, which may be easily molded into the desired configuration. In the example of FIG. 3C. the skeleton 430 is enclosed within a two-piece housing 420 including upper and lower housing halves, 422, 424. The halves may be chemically or mechanically attached to the skeleton. As shown, a portion of the skeleton 430 extends out of the housing to allow components, such as acoustic grill 240 to be directly attached thereto.

Figure 15:
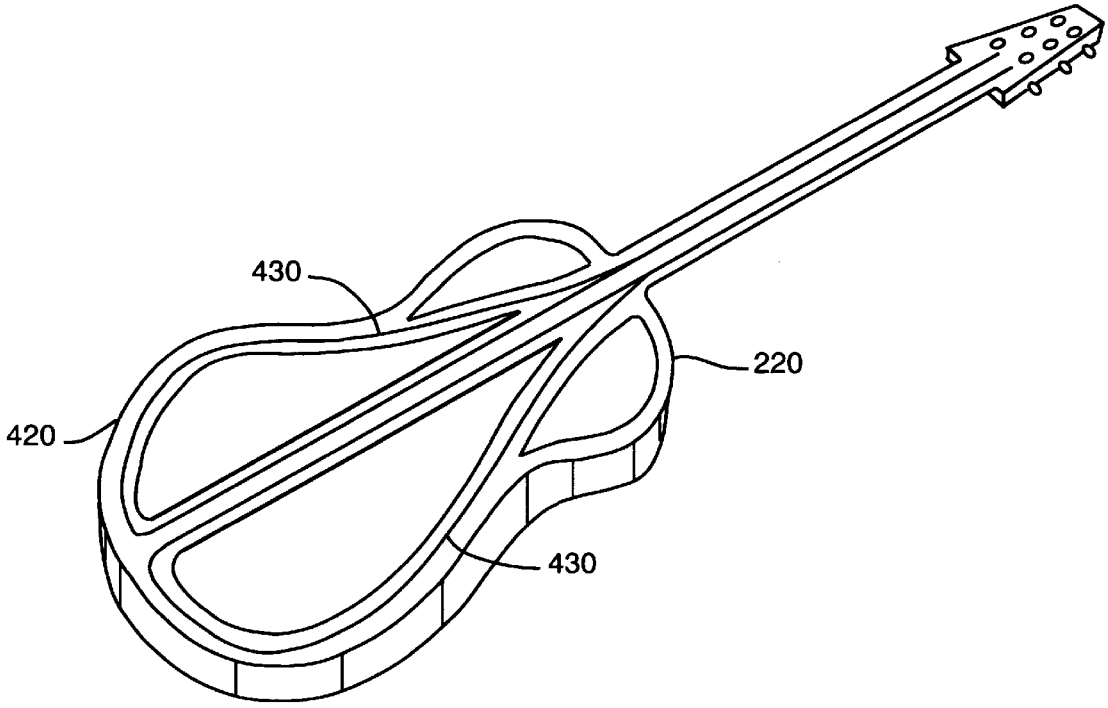
FIG. 15 is a perspective view of a guitar body frame showing a structural skeleton housed within a housing, which extends through the guitar neck to the headstock.

The structural frame may be limited to the stringed instrument body as shown in FIG. 3B or it may extend through the entirety of the stringed instrument system, including the instrument neck as shown in FIG. 15. Of course, this latter arrangement would not allow such an instrument to be disassembled to facilitate transportation and storage.

Guitar body section 200 also includes a soundboard system comprising an acoustic grill 240 (FIGS. 2, 5A, 5B, 12 and 13). In a first embodiment, acoustic grill 240 comprises first and second acoustic grill sections 242 and 243. Grill sections 242 and 243 each include peripheral rim sections 244 and 245, which corresponds substantially to the peripheral shape of guitar body peripheral members 228 and 229, respectively. Acoustic grill sections 242 and 243 also include retention members 246, which in the disclosed embodiment include holes through which fasteners 248 can be inserted. Holes 246 correspond to receivers 232 (FIG. 3) disposed within the underside of structural body frame sections 222 and 223. In the preferred embodiment, receivers 232 comprise threaded holes or inserts, into which threaded fasteners 248 are threaded to hold grill sections 242 and 243 to the underside of structural body frame sections 222 and 223, respectively.

Acoustic grills 242 and 243 are only joined to body frame sections 222 and 223 along peripheral rims 244 and 245 respectively, central, longitudinally disposed sections 248 and 249 remain free to allow for optimum vibration of acoustic grill sections 242 and 243.

In a second embodiment (FIGS. 12 and 13) the acoustic grill 240 comprises only a first acoustic grill section 242 with a peripheral rim section 244, which corresponds substantially to the peripheral shape of guitar body peripheral members 228 and 229. The acoustic grill section is attached to the guitar body peripheral members 228 and 229 using fasteners 248, in a manner similar to that described above with respect to the embodiment including two grill sections. However, alternative attachment systems may be employed as well. For example, if a guitar is not configured to be disassembled, then the grill section could be attached permanently to the peripheral rim members. Such permanent attachments could be accomplished using chemical bonding agents, permanent fasteners or the like. In any event, permanent attachment would eliminate the ability to readily replace components included in such an instrument.

Each acoustic grill section 242 is made up of a lattice-like grillwork 250 which may be made from any one of a number of acceptable materials, such as fiberglass, light metals, such as aluminum, composite materials, or glass. The grillwork 250 (FIGS. 5A, 5B, 12 and 13) comprises a mesh with variable spacing and shapes of the grill mesh members 252. The exact spacing and design of the grill mesh can vary to adjust or vary the acoustical qualities of the instrument.

In order to impart sufficient structural integrity to the grillwork 250, strength members 256 are overlaid onto grill mesh members 252. The strength members 256 provide the analog to soundboard bracing members found on wooden soundboard guitars and, like their wooden counterparts may be applied in a wide variety of shapes, sizes and patterns to produce differing acoustical performance characteristics for their respective instruments. The strength members are also sized, shaped, oriented and arranged such that the acoustic grill sections will have their maximum stiffness at the bridge attachment points 254 and their maximum flexibility at their peripheries, including their longitudinally disposed sections 248 and 249 and their peripheral members 228 and 229 at locations remote from the bridge attachment points 254.

Figure 6:
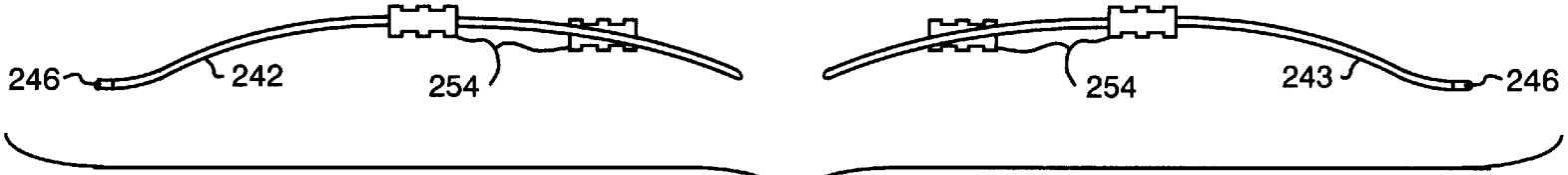
FIG. 6 is a sectional view of the acoustic grill sections shown in FIG. 5A along axis 66.
Figure 7:
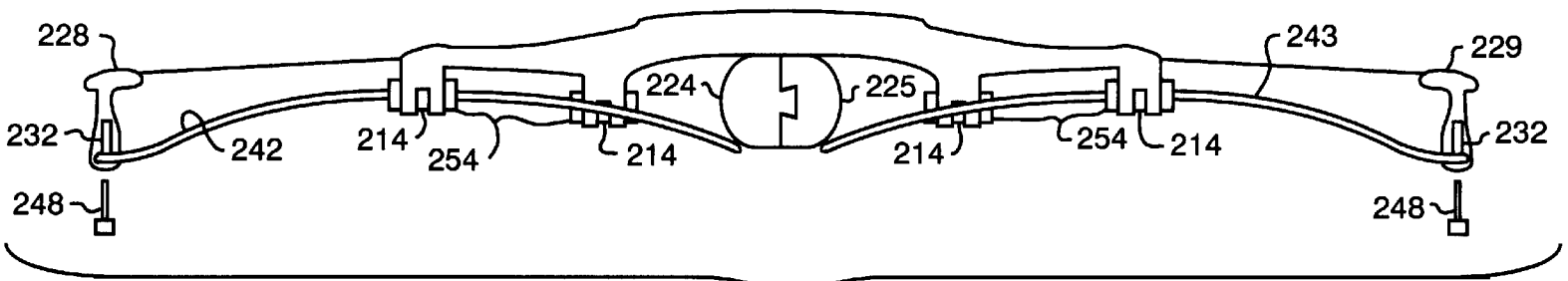
FIG. 7 is a sectional view of first and second acoustic grill sections shown joined by the guitar bridge and attached to the guitar body structural frame member.

As shown in FIG. 6, the acoustic grills 242 and 243 may be domed to provide greater grill area within the confines of the dimensions of the guitar structural frame. This configuration would be especially useful in the single piece soundboard embodiment to allow the grill to pass around the central member of the structural frame. Acoustic grill sections may also be pre-stressed in a longitudinal fashion to counteract forces applied by guitar string tension.

In order to provide acoustical qualities substantially corresponding to traditional wooden guitars, grill mesh spacing (or grill pitch) should fall within the range of 0.5 inches to 2.0 inches. This spacing or grill pitch range is desirable to allow the guitar soundboard analog to produce sound waves corresponding the typical guitar tone frequencies, including high frequency sound waves having frequencies of substantially 6,000 Hz, which have wavelengths of substantially 0.75 inches.

One advantage of embodiments that utilize removable acoustic grills is that they allow for the interchangeability of acoustic grill sections within a single structural body frame. Thus, the acoustic qualities of such a stringed instrument can be adjusted by replacing grills. Also, it is envisioned that grill sections will be manufactured from materials that vary in expense. Accordingly, an entry level instrument can be upgraded to a performance level instrument by replacing acoustic grills. Other components, such as the structural body frame 220, neck 300, headstock 400 and bridge 210 may be continued to be used. Of course, any one of those sections could be replaced as well.

Like its prior art inflatable guitar sibling, the modular guitar system 100 of the described embodiment of the present invention utilizes a quick release-type assembly for removably attaching guitar bridge 210 to the acoustic grill sections 242 and 243. Each grill section includes two bridge attachment points 254, which are connected to grill section strength members in order to provide the requisite strength to the grill sections at these critical areas. However, unlike the dovetail arrangement used in the prior art Chrysalis guitar, the bridge of the present invention uses hook-shaped members 212, which project from the underside of the bridge 210 to cooperate with the grill attachment points 254. In the preferred embodiment, each hook-shaped member includes twin hooks 215, which straddle a grill strength member that runs longitudinally through the center of each bridge attachment point and engage the bridge attachment points 254.

In order to provide additional strength to the structure, one embodiment of the hook-shaped members 212 includes a molded pin 214 associated with each hook-shaped member 212, which engages a corresponding hole 255 in each grill attachment point 254. In order to install the bridge onto the grill sections 242 and 243, the bridge 210 is lined aligned with the grill sections such that each hook-shaped projection lines up with its corresponding bridge attachment point 254 is then rotated, headstock end upward and the hook-shaped projections are lowered such that their respective hooks 215 engage the bridge attachment points 254 from the end of the body distal from the neck attachment end. The bridge is then rotated in the opposite manner (headstock end downward) as the bridge is slid towards the neck attachment end of the guitar body until the pins 214 engage their corresponding holes 215. Like its prior art sibling, once the bridge is installed it is held in place by string tension.

In order to provide proper acoustic guitar compliance, one embodiment of the disclosed modular guitar system 100 includes an inflatable acoustic chamber 260 (FIG. 2), which is attached to the guitar body structural body 220. The inflatable acoustic chamber 260 includes an outer flexible, protective envelope 262, which houses an inner inflatable bladder 264. Envelope 262 corresponds to the peripheral shape of the guitar body and provides protection to bladder 264 to prevent bladder 264 from rupturing easily. Bladder 264 may also be in the shape of the guitar body 220. However, this is not required. In any event, inflatable acoustic chamber 260 is joined to the guitar body structural frame along its peripheral members 228 and 229 using attachment means 280*a* and 280*b*, which may include zippers, Velcro or other quick release fasteners.

The envelope 262 may only cover the back (i.e. the portion of the bladder that does not communicate with the acoustic grillwork) 7 of the bladder 264, thus allowing the bladder 264 itself to communicate directly with the acoustic grillwork 250. In this manner, the acoustic qualities of the instrument may be varied by selecting different bladder materials. For example, a bladder constructed of a mylar or similar material will provide a bright tone to the instrument, while a bladder constructed of a latex or other rubber-like material will provide a more mellow tone. Accordingly, the acoustic characteristics of the instrument may be varied by changing the inflatable bladder 264.

Alternatively, in another embodiment, the envelope may completely enclose or encase the bladder 264. In this embodiment, the envelope material will form a layer communicating with the acoustic grillwork 250 intermediate the bladder 264 and the grillwork 250.

The material selected for the portion of the envelope communicating with the grillwork can be selected to provide desirable aesthetic qualities to the instrument since this portion of the envelope will be visible through the grillwork 250 as the instrument is viewed from the front. For example, distinctive designs may be imprinted or otherwise applied to the visible portion of the envelope material to distinctly identify the instrument. Materials may also be selected to alther the acoustic qualities of the instrument in much the same manner as bladder materials will when they communicate directly with the acoustic grillwork, as mentioned above. Accordingly, with this embodiment, a single bladder may be utilized with multiple, different envelopes to vary the acoustic qualities of a single instrument.

Figure 10:
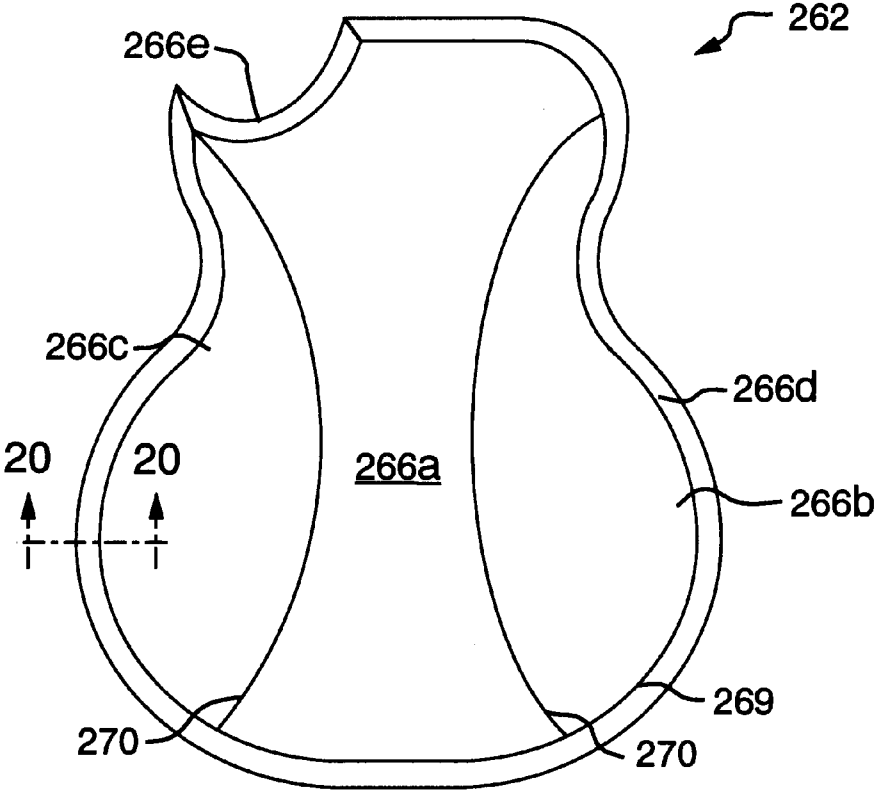
FIG. 10 shows a back view of the protective envelope, which houses the inflatable bladder of the inflatable guitar of the present invention.
Figure 12:
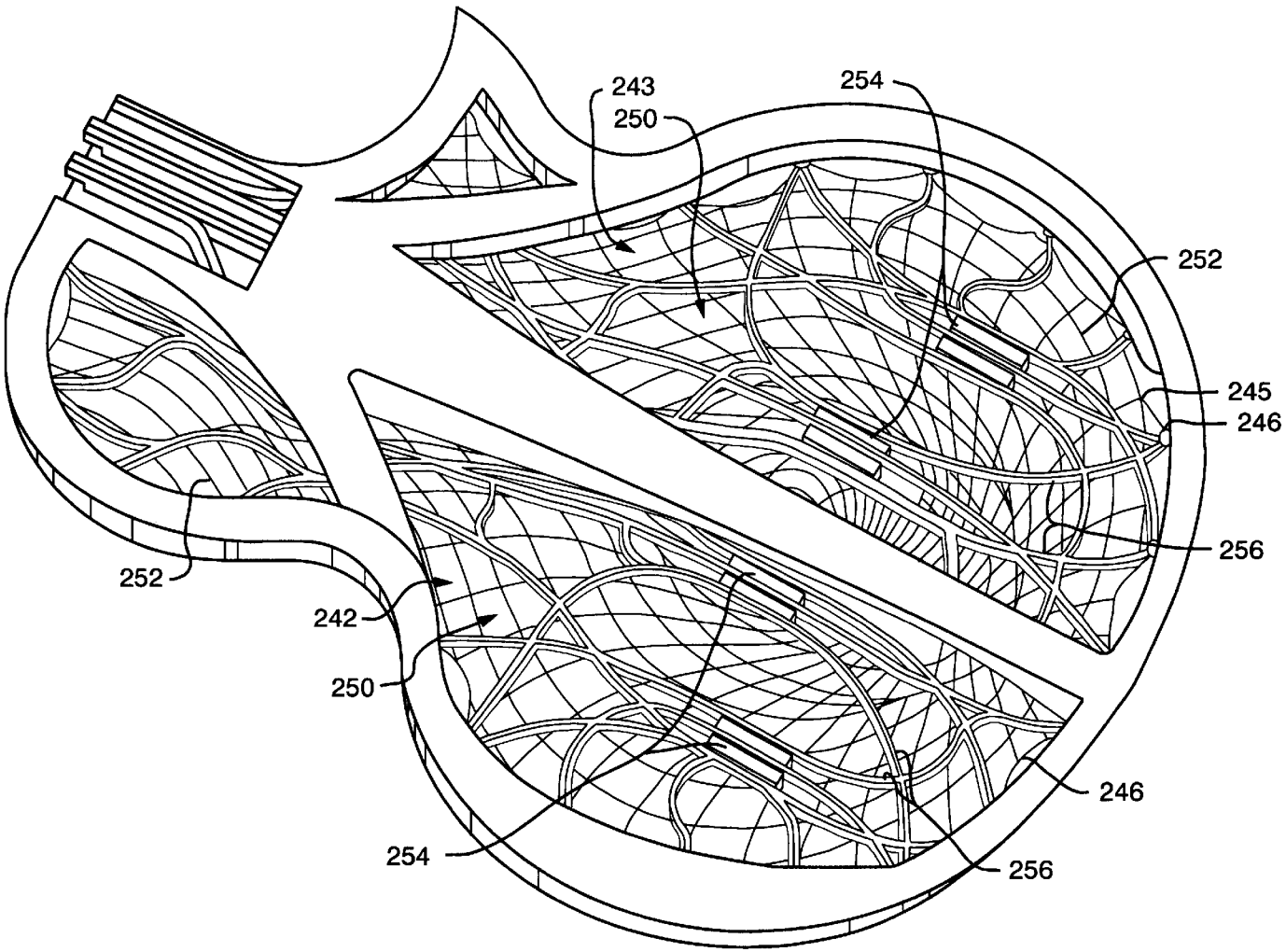
FIG. 12 is a top perspective view of a stringed instrument soundboard system according to another embodiment of the invention.
Figure 13:
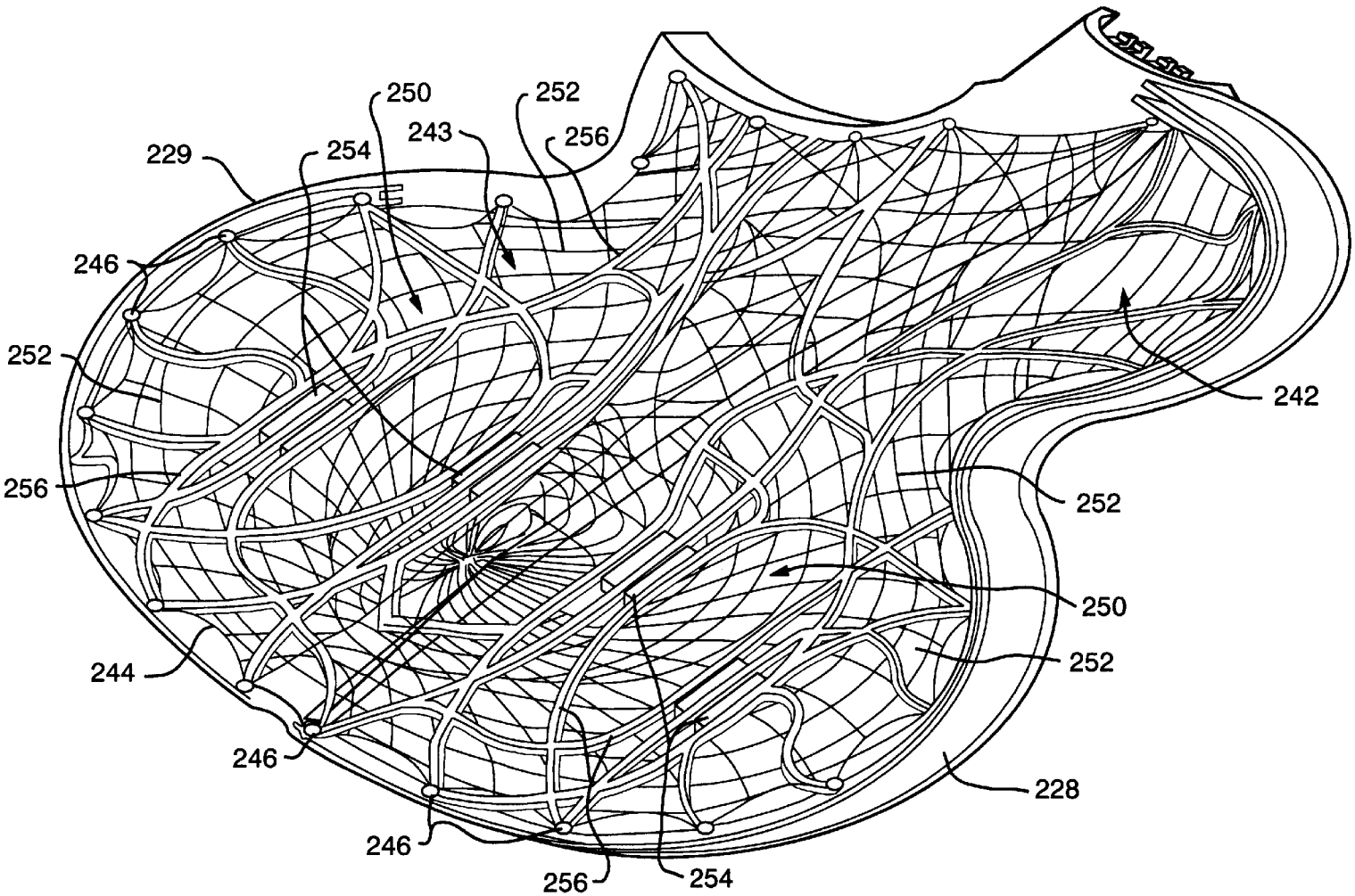
FIG. 13 is a bottom view of the stringed instrument soundboard system of FIG. 12.

Since an inflatable bladder will tend to try to expand in a spherical fashion, which would not be desirable for the shape of a guitar back, the protective envelope may be constructed out of a number envelope members, which may be, for example, pieces of a flexible fabric, such as cotton. The envelope members are joined, for example, using common sewing techniques to aid in providing a proper guitar back-like shape to the inflatable bladder. FIG. 10 shows a protective envelope 262, which is made up of a number of fabric sections 266*a–e* that are joined to form the protective envelope. Shaping seams, such as plateau seam 269 and princess seams 270, aid in forming the proper guitar back-like shape to the protective envelope 262.

Figure 11:
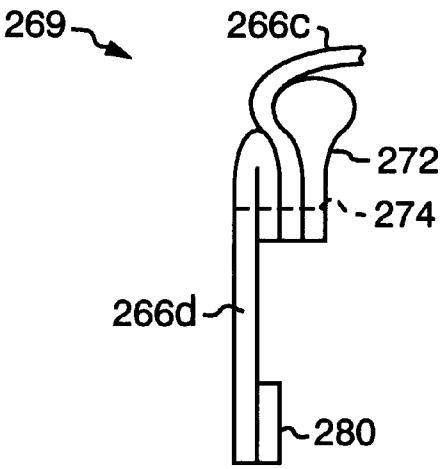
FIG. 11 shows a sectional view of the protective envelope components, which aid in approximating the shape of a wooden acoustic guitar.

The details of plateau seam 269 are shown in FIG. 11. The plateau seam 269 is formed by joining side panel 266*d* to back panel 266*c* in combination with a stiffening element 272. In the preferred embodiment, stiffening element 272 comprises boning, which provides stiffness, and thus shape to the seam. The boning 272 is preferably attached to side panel 266*d* as well as to top panel 266*c* using stitches 274 according to well known sewing techniques in the configuration shown in FIG. 10.

Figure 16:
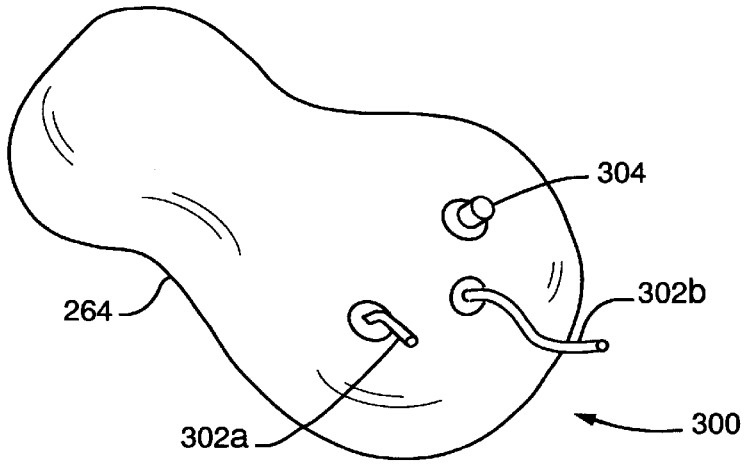
FIG. 16 is a perspective view of an inflatable acoustic chamber including a plurality of inflation and deflation valves.

The inflatable bladder 264 includes at least one inflation/deflation valve 300 (FIG. 16) to allow air (or other gaseous inflation medium) to be used to inflate the chamber. In the preferred embodiment, separate inflation and deflation valves 302 and 304, respectively, may be included in the bladder. With this arrangement, the inflation valve 302 preferably comprises a one-way valve 302A to allow the gaseous inflation medium to be introduced into the acoustic chamber. Such a valve may be similar to a standard tire inflation valve which would allow the acoustic chamber to be inflated using pressurized inflater devices, pumps or the like.

The inflatable acoustic chamber would also preferably include a separate deflation valve 304 which would be ideally configured to allow the acoustic chamber to be rapidly deflated when desired.

Finally, a third, manual inflation valve 302B may be included to allow a person to inflate the acoustic chamber in much the same way that he or she would blow up an inflatable beach toy or the like.

Figure 14:
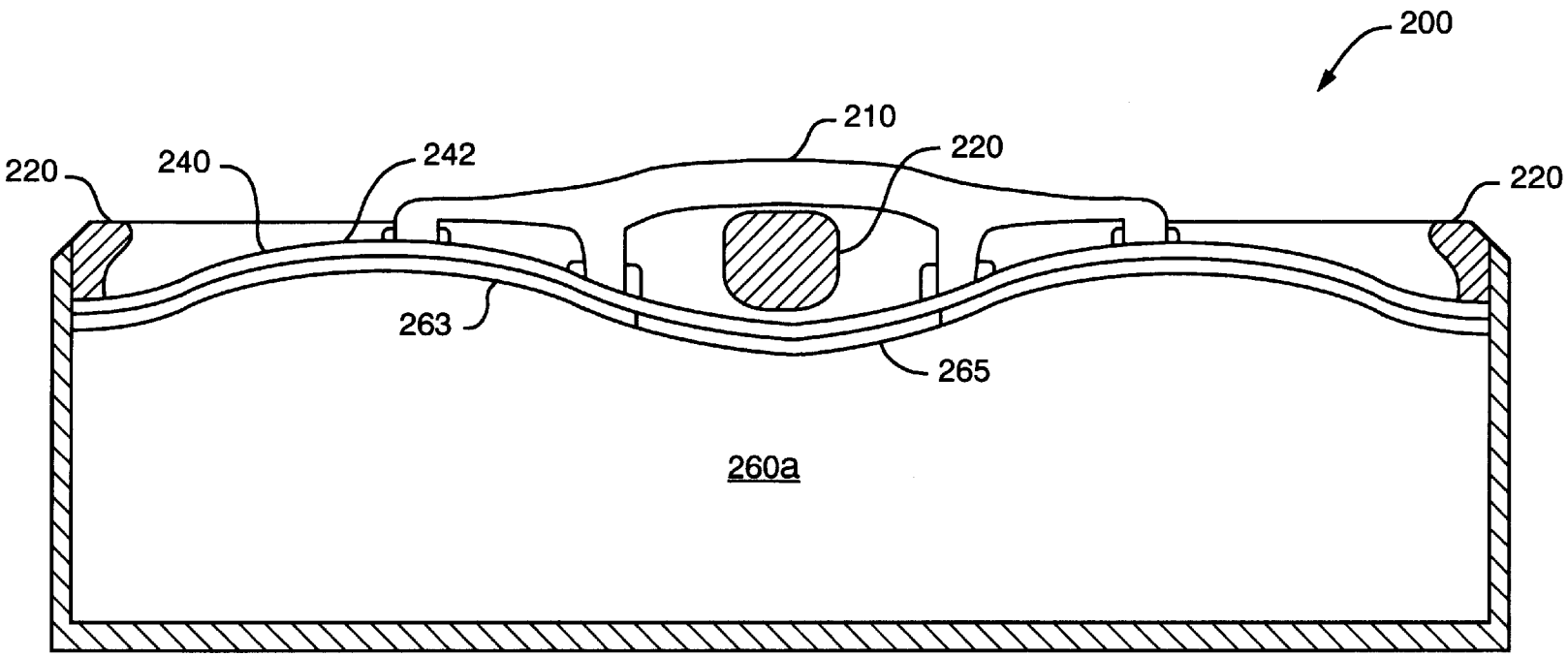
FIG. 14 is a sectional view of the guitar body of a rigid-back stringed instrument including a soundboard system according to the present invention.

Of course, the invention contemplates the inclusion of the disclosed soundboard system on stringed musical instruments incorporating more traditional constructions. For example, an instrument including a rigid (non-inflatable) acoustic chamber 260A, as shown in FIG. 14, with or without removable necks, may include an acoustical grill 240 incorporating one or more acoustic grill sections 242 as described above. However, since these embodiments do not include an inflatable acoustic bladder 262 (FIG. 2), a separate air impermeable membrane 263 must be attached to the acoustic grill 240 to allow it to move a volume of air within rigid acoustic chamber 260A upon vibration and thus create audible sound waves. The air impermeable membrane 263 may be selected from any material that will move air, thereby creating sound waves during vibration of the acoustic grill section(s) 242. Such suitable materials include plastics, rubbers, latex or even more traditional instrument making materials, such as wood. However, since the entire structure of the instrument would be born by the grillwork and strength members, the air impermeable membrane 263 may be ultra-thin. The membrane may be applied to the grillwork on either side thereof and may be bonded thereto using any suitable bonding agent or method, such as glues or thermal bonding techniques.

The membrane may have one or more soundhole 265 included therein in a manner similar to traditional prior art stringed instruments.

One embodiment of the modular guitar system of the present invention includes a novel neck construction and neck to body joint as is more fully described in commonly-owned U.S. patent application Ser. No. 09/129,931, which is incorporated herein by reference.

Accordingly, the disclosed invention provides an improved stringed instrument soundboard system, which includes a soundboard frame and at least one acoustic grill section attached to the soundboard frame. The acoustic grill may be manufactured from composites or other materials and includes a lattice-like grillwork having a mesh with variable spacing and shapes of the grill mesh members, which is overlaid with strength members to provide sufficient structural integrity to the acoustic grill. The acoustic grill communicates with an air impermeable membrane, which may be attached to the grillwork or provided as a separate bladder in order to allow the soundboard system to displace a volume of air upon vibration in order to generate acoustic sound waves. The soundboard system may be included in a modular stringed instrument system or in a unitary, rigid stringed instrument system.

Modifications and substitutions by one of ordinary skill in the art are considered to be within the scope of the present invention which is not to be limited except by the claims which follow.

What is claimed is:

1. A soundboard system for a stringed musical instrument comprising:

a structural body frame, said body frame having first and second body frame ends and a peripheral rim member communicating with said first and second body frame ends for defining a peripheral shape of said body frame; and an acoustic grill attached to said body frame peripheral rim member, said acoustic grill having at least one acoustic grill section including a lattice-like acoustic grillwork overlaid with strength members, said at least one acoustic grill section having a peripheral edge corresponding substantially to the shape of said body frame peripheral rim member, said lattice-like acoustic grillwork comprising a mesh with variable spacing and shapes of grill mesh members.

2. The soundboard system for a stringed musical instrument of claim 1, further comprising a string bridge communicating with at least one bridge attachment point disposed on at least one of said acoustic grill strength members, said string bridge retaining at least one instrument string at a bridge end of said string and acoustically coupling said at least one instrument string to said at least one acoustic grill section.

3. The soundboard system for a stringed musical instrument of claim 1, wherein said at least one acoustic grill section comprises first and second acoustic grill sections, each of said first and second grill sections having a peripheral edge corresponding to the shape of, and attached to, said body frame peripheral rim member and a free edge disposed substantially along a longitudinal axis of said stringed instrument.

4. The soundboard system for a stringed musical instrument of claim 3, further comprising a string bridge straddling said first and second acoustic grill section free edges and communicating with at least one bridge attachment point disposed on at least one of said acoustic grill strength members on each of said first and second acoustic grill sections, said string bridge retaining at least one instrument string at a bridge end of said string, said string bridge acoustically coupling said at least one instrument string to said first and second acoustic grill sections.

5. The soundboard system for a stringed musical instrument of claim 1 further comprising an acoustic chamber.

6. The soundboard system for a stringed musical instrument of claim 5, wherein said acoustic chamber comprises an inflatable bladder, said bladder retained against said at least one acoustic grill section and providing a volume of air communicating with said at least one grill section to produce sound waves in response to vibration of said at least one grill section.

7. The soundboard system for a stringed musical instrument of claim 5, wherein said acoustic chamber comprises a rigid acoustic chamber attached to said body frame peripheral rim member and an air-impermeable membrane communicating with said at least one grill section.

8. The soundboard system for a stringed musical instrument of claim 7 further comprising at least one soundhole penetrating said membrane.

9. The soundboard system for a stringed musical instrument of claim 1, wherein said at least one acoustic grill section is pre-stressed to minimize deformation when said at least one acoustic grill section is exposed to string tension.

10. The soundboard system for a stringed musical instrument of claim 1, wherein said lattice-like grillwork comprises a grill pitch substantially between 0.5 and 2.0 inches.

11. The soundboard system for a stringed musical instrument of claim 1, wherein said body frame comprises a structural skeleton enclosed within a housing.

12. The soundboard system for a stringed musical instrument of claim 11, wherein said structural skeleton extends from said body and through a stringed instrument neck.

13. The soundboard system for a stringed musical instrument of claim 11, wherein said housing comprises upper and lower housing halves attached to said structural skeleton.

14. The soundboard system for a stringed musical instrument of claim 11, wherein said structural skeleton extends from said housing to allow said acoustic grill to be attached directly thereto.

15. The soundboard system for a stringed musical instrument of claim 6 further comprising an envelope at least partially enclosing said inflatable bladder, said envelope removably attached to said body frame peripheral member to hold said acoustic bladder directly against said acoustic grillwork.

16. The soundboard system for a stringed musical instrument of claim 15, wherein said envelope totally encloses said inflatable bladder, said envelope removably attached to said body frame peripheral member and having a portion communicating with said acoustic grillwork intermediate said inflatable bladder and said acoustic grillwork.

17. The soundboard system for a stringed musical instrument of claim 16, wherein said envelope is constructed of a material selected to provide desired acoustic qualities to said instrument.

18. The soundboard system for a stringed musical instrument of claim 6, wherein said inflatable bladder is constructed of a material selected to provide desired acoustic qualities to said instrument.

19. The soundboard system for a stringed musical instrument of claim 1 further comprising an air impermeable membrane attached to said acoustic grill.

20. The soundboard system for a stringed musical instrument of claim 1, wherein said structural body frame further comprises a central member disposed along a longitudinal axis of said body frame intermediate said first and second body frame ends.

* * * * *